United States Patent [19]

Warrington

[11] 3,938,427

[45] Feb. 17, 1976

[54] PERCUSSION HAMMER

[75] Inventor: Henry G. Warrington, Delray Beach, Fla.

[73] Assignee: Vulcan Iron Works, Inc., Chattanooga, Tenn.

[22] Filed: Feb. 11, 1974

[21] Appl. No.: 441,027

Related U.S. Application Data

[63] Continuation-in-part of Ser. No. 273,164, July 19, 1972, abandoned.

[52] U.S. Cl. ..... 92/107; 92/109; 173/139; 254/29 A

[51] Int. Cl.[2] ..... E21B 19/00; E01B 31/00

[58] Field of Search ..... 92/108, 169, 107, 109; 254/29 A; 173/134, 139

[56] References Cited

UNITED STATES PATENTS

| | | | |
|---|---|---|---|
| 1,132,321 | 3/1915 | Ferguson | 173/134 X |
| 2,948,122 | 8/1960 | Smith | 173/139 X |
| 2,955,578 | 10/1960 | Flessate et al. | 92/108 X |
| 2,993,448 | 7/1961 | Garey | 254/29 A X |
| 3,015,975 | 1/1962 | Biach | 92/107 X |
| 3,154,006 | 10/1964 | Novak | 254/29 A X |
| 3,194,536 | 7/1965 | Simms | 254/29 A |
| 3,362,682 | 1/1968 | Meschonat et al. | 254/29 A |
| 3,375,881 | 4/1968 | Myers et al. | 173/139 |
| 3,722,332 | 3/1973 | Jones | 254/29 A X |
| 3,811,653 | 5/1974 | Persicke | 254/29 A |

FOREIGN PATENTS OR APPLICATIONS

| | | | |
|---|---|---|---|
| 60,415 | 2/1968 | Germany | 92/108 |

*Primary Examiner*—Irwin C. Cohen
*Assistant Examiner*—Abraham Hershkovitz
*Attorney, Agent, or Firm*—Mason, Kolehmainen, Rathburn & Wyss

[57] ABSTRACT

There is provided an improved percussion hammer having tie cables connecting the base of the hammer body with the upper cylinder. Cable tensioning jacks are used for preloading the tie cables. Each cable tensioning jack includes a jack body having a central opening for securing a cable, and having an annular groove defining a jack cylinder closed at one end and open at the other. An annular jack piston is slidably received within the jack cylinder. The annular cylinder is pressurized to expand the jack. In one embodiment of the invention high pressure grease provides the source of pressurized fluid.

9 Claims, 7 Drawing Figures

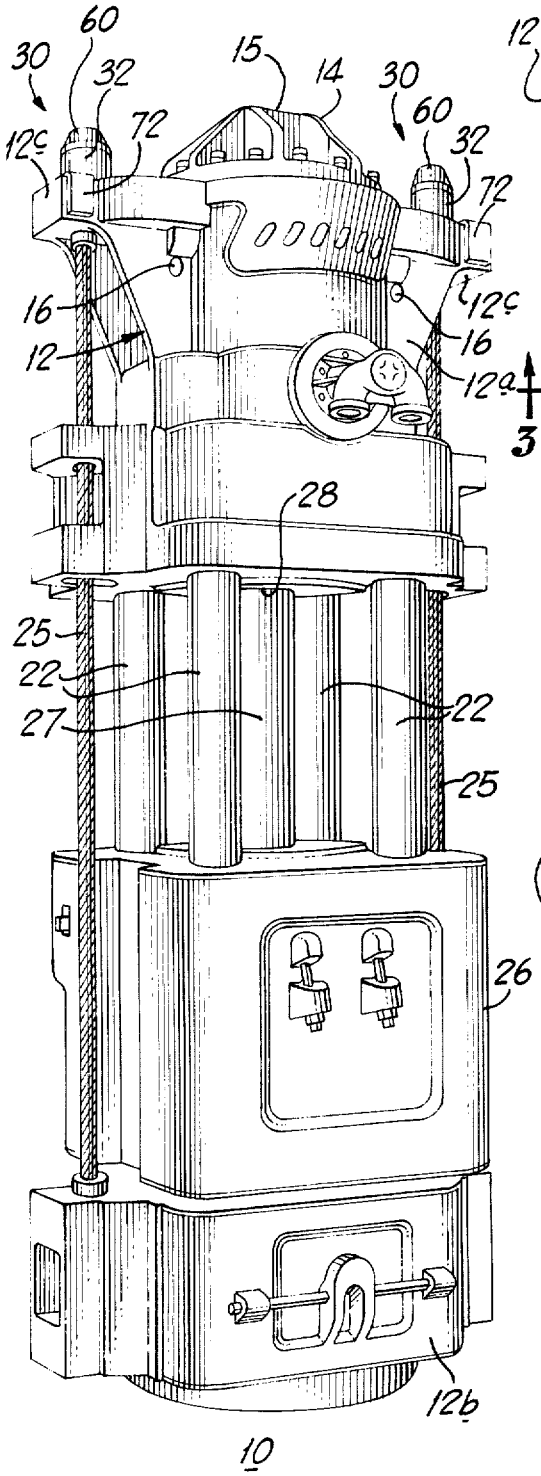
FIG. 1
FIG. 2
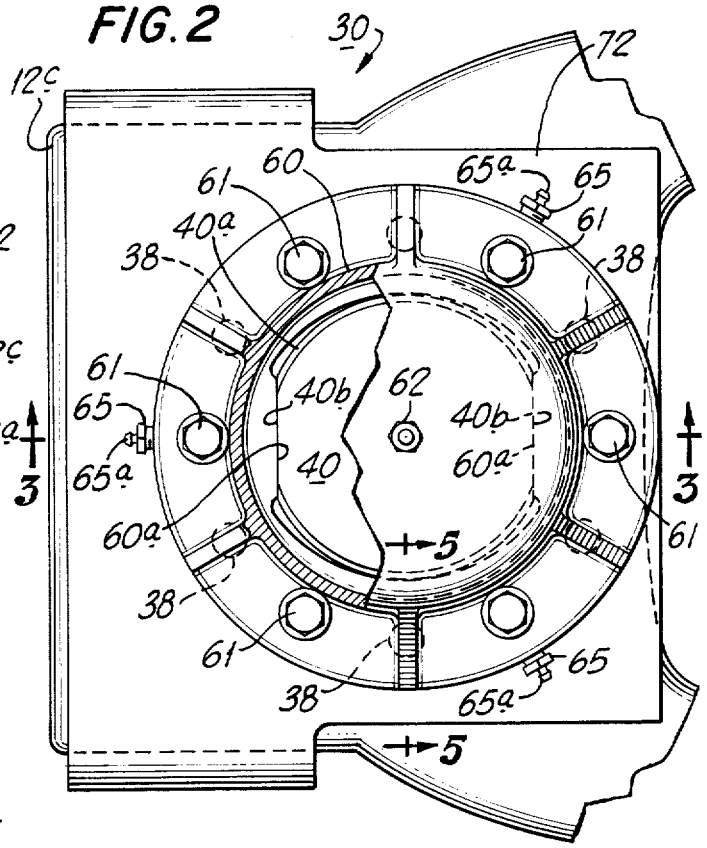
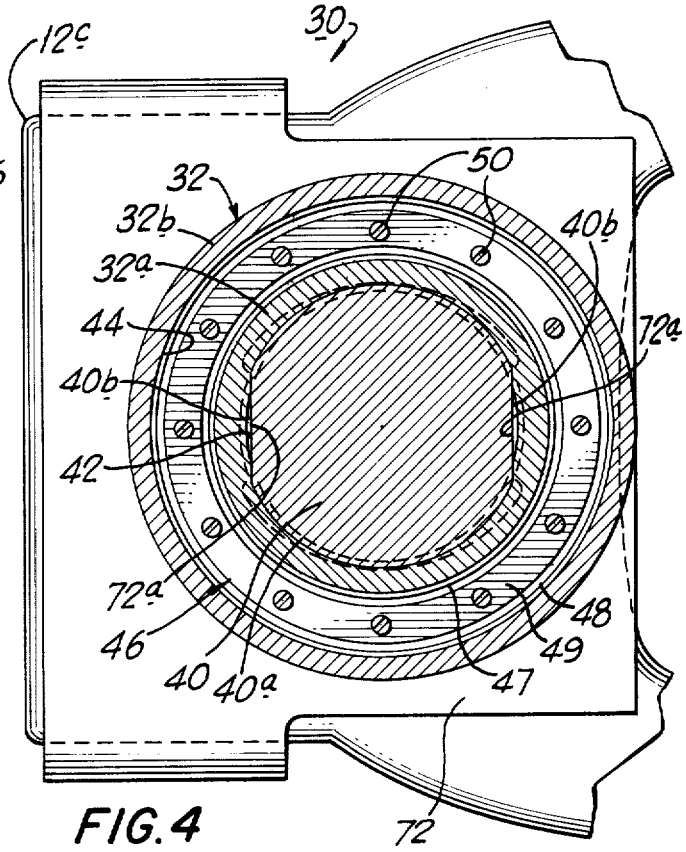
FIG. 4

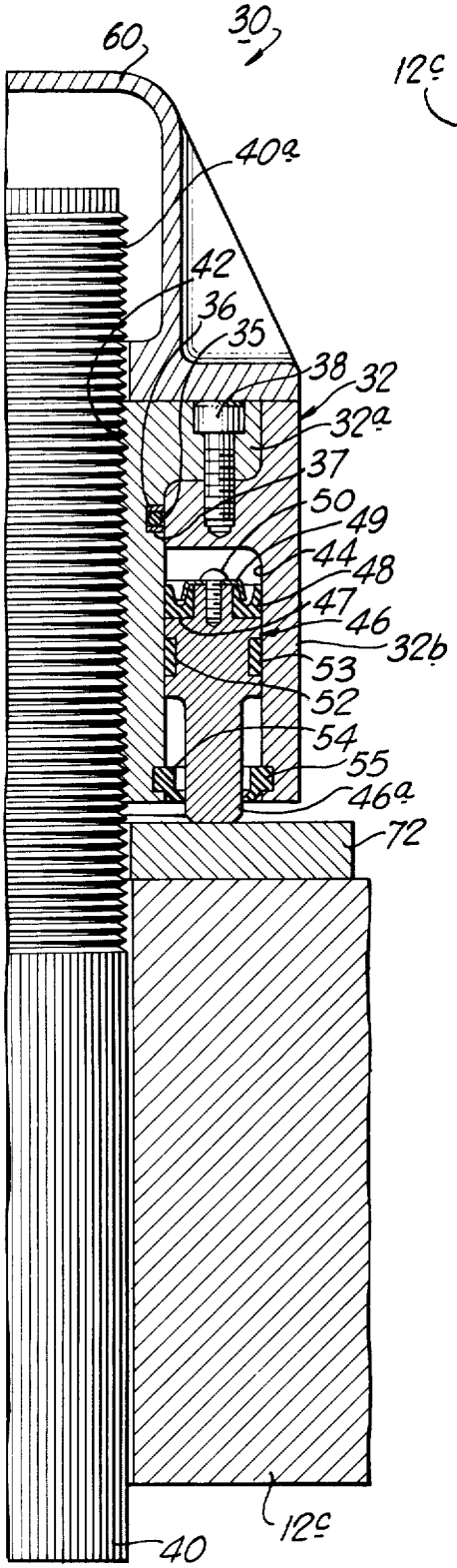
FIG. 5
FIG. 6
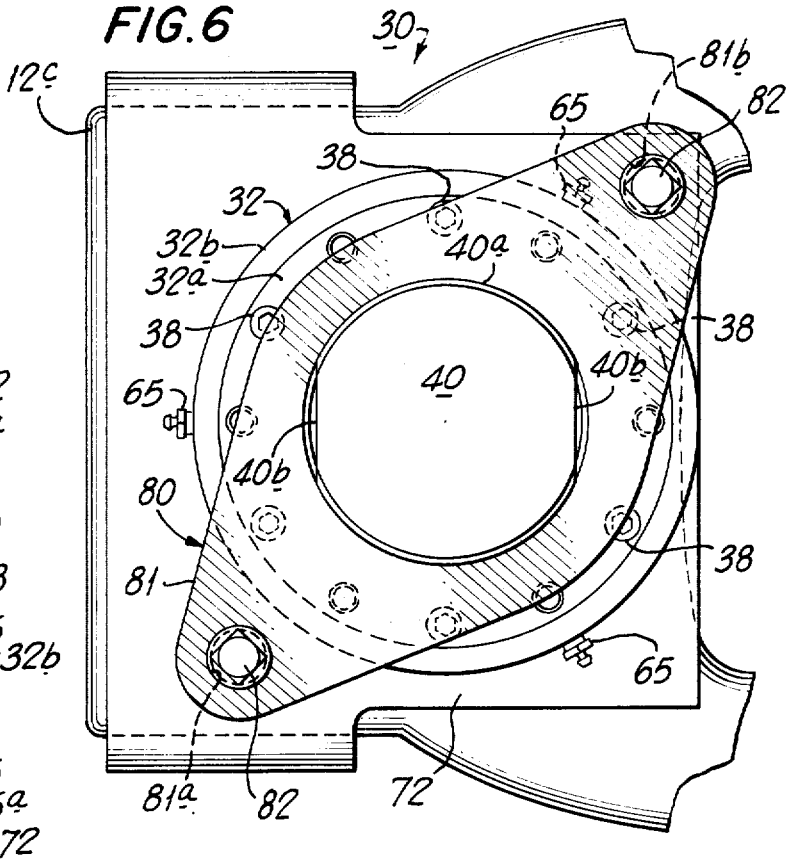
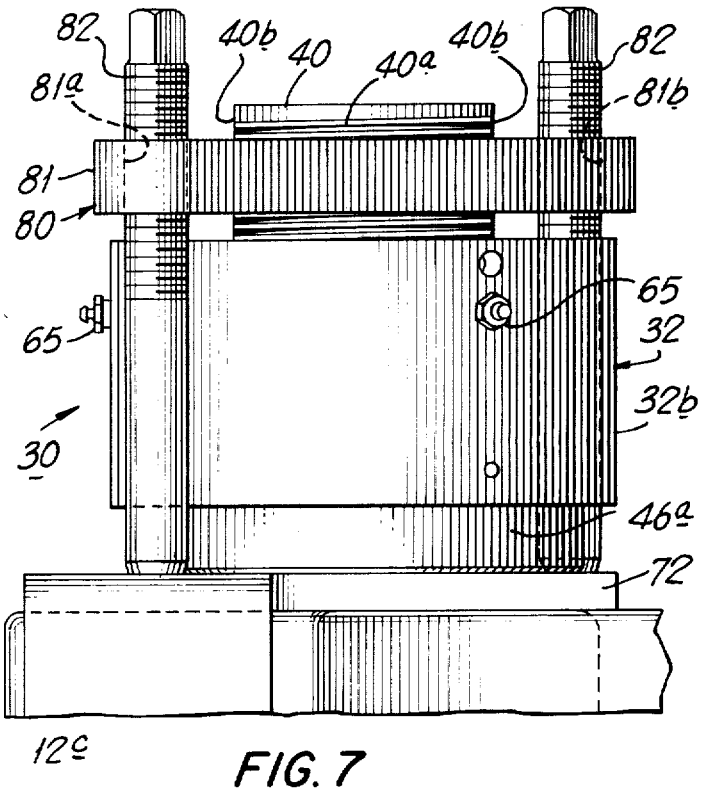
FIG. 7

PERCUSSION HAMMER

The present application is a continuation-in-part application of my application, Ser. No. 273,164, filed July 19, 1972, now abandoned.

The present invention relates to a new and improved percussion hammer of the type having tie cables connecting the body base and the upper cylinder of the hammer for improved means for pretensioning of the tie cables.

Conventional percussion hammers such as are used for pile driving and the like normally include a ram reciprocally mounted on a hammer body movable between an upper cylinder assembly and a body base. Conventionally the base of the body is secured to the upper cylinder assembly by suitable tie means. One such means of tying the hammer base to the upper cylinder assembly is by use of tie cables interconnecting the hammer base and the upper cylinder assembly. Such cable ties must be prestressed equally to provide a hammer body resembling rigid construction. In the larger sizes of pile driving percussion hammers, such as those used in offshore operation and weighing in the range of 30 to 60 tons, it may be desired to prestress the cable ties to a final tension in the area of 40 tons for each cable tie. Heretofore difficulty has been experienced in the pretensioning of such cable ties.

Accordingly, it is an object of the present invention to provide a new and improved percussion hammer.

Another object of the present invention is the provision of a new and improved cable tensioning device particularly useful on pile driving percussion hammers.

Still another object of the present invention is the provision of a new and improved device for applying pretension to cable ties of percussion hammers.

Briefly, in accordance with these and other objects and advantages of the present invention, there is provided an improved percussion hammer using cable tensioning jacks. Each cable tensioning jack includes a jack body provided with a central opening for securing a cable end portion, and has concentrically therewith an annular groove defining an annular jack cylinder closed at one end and open at the other. An annular jack piston is slidably received within the jack cylinder. In accordance with the present invention the introduction of pressurized fluid into the closed end of the cylinder, or the bleeding of the fluid therefrom, will project or retract the jack piston. It has been found that the utilization of high pressure grease provides desirable operation. The high pressure grease may be introduced into the jack cylinder from a high pressure grease gun through a conventional type grease fitting having a one-way check valve incorporated therein. Thus, there is provided a cable tensioning jack which is particularly useful for pretensioning cable ties of a percussion hammer. The cable tensioning jack functions easily with a fluid source commonly available on sight, and permits close control of the pretension through regulation of the applied pressure into the jack cylinder.

For a better understanding of the present invention reference should be made to the following detailed description taken in conjunction with the drawings in which:

FIG. 1 is a perspective view of a pile driving percussion hammer employing improved cable tensioning jack according to the present invention;

FIG. 2 is a fragmentary top plan view of the percussion hammer of FIG. 1 illustrating a cable tensioning jack according to the present invention;

FIG. 4 is a cross sectional plan view of the cable tensioning jack taken along line 4—4 of FIG. 3;

FIG. 5 is a fragmentary cross sectional elevational view of the cable tensioning jack taken along line 5—5 of FIG. 2;

FIG. 6 is a plan view of the cable tensioning jack in combination with a manual jack; and FIG. 7 is an elevational view of the jack combination of FIG. 6.

Figure 3:
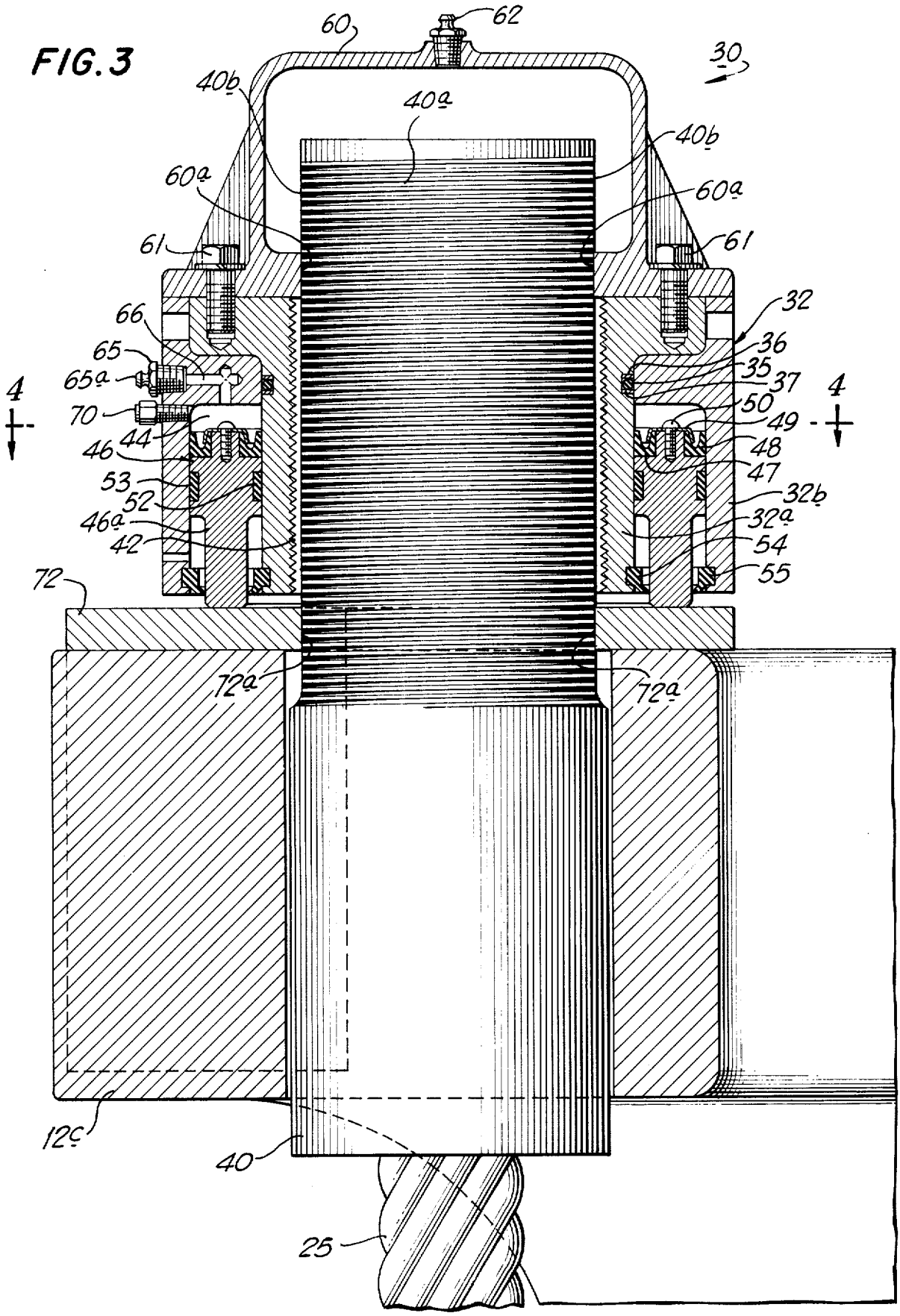
FIG. 3 is a cross section elevational view of the cable tensioning jack of FIG. 1 taken along line 3—3 of FIG. 2.

Referring now to the drawings, and particularly to FIG. 1, there is illustrated a pile driving percussion hammer 10 and employing cable tensioning jacks according to the present invention. The percussion hammer 10 may be of any suitable design, and, for example, may be of the type illustrated in U.S. Pat. No. 3,566,977 granted Mar. 2, 1971 to George C. Wandell and assigned to the same assignee as the present invention. The percussion hammer 10 is operated by suitable working fluid, such as steam, in a known manner. As illustrated, the percussion hammer 10 includes a housing 12 having an upper housing or cylinder portion **12*a* and a lower housing or base portion 12*b*. The upper housing portion 12*a* defines a working cylinder closed at its upper end by a cylinder head 14 having means 15 permitting hoisting or support of the percussion hammer 10 by a crane or other suitable means for placement on top of a pile. Wire rope saddles 16 are provided on the illustrated embodiment so that the hammer may be hoisted or handled without attaching to the cylinder head if so desired. Also, the saddle 16 may be used for safety slings to prevent dropping of the hammer should the hammer hoisting cable break. The upper housing portion 12*a*** additionally includes a steam chest having suitable valving (not shown) to provide the working cycling of the tool.

The housing 12 additionally includes the base portion **12*b* connected to the upper portion 12*a* by opposed side guide columns 22 and held together by a plurality of tie cables 25. Each of the tie cables 25 is secured to the base 12*b* at its lower end and extends through aperture 29 in a projection or jaw 12*c* of the upper housing 12*a*. A ram assembly 26 is adapted to be reciprocated vertically guided by the columns 22. A piston (not shown) in the cylinder is connected to the ram assembly 26 by a piston rod 27 which extends through suitable packing 28 in the upper housing unit 12*a***.

The operating cycle of the percussion hammer may be of any known type and may be of the type illustrated in the above identified United States patent granted to Wandell.

Commercially available percussion hammers of the type illustrated may weigh in the range of 30 to 60 tons, and in order to secure the base **12*b* with the upper housing portion 12*a* the tie cables 25 may be prestressed or loaded to a load of approximately 40 tons each. The preloading of the cables 25 may readily be accomplished in accordance with the present invention by suitable cable tensioning jacks 30** illustrated at the upper end of each cable.

Referring now to the jack 30 best illustrated in FIGS. 2 through 4, the jack 30 comprises a two piece jack body 32 formed of body portions **32*a* and 32*b*. The body portions 32***a*, 32*b* are joined together to form an integral body, a hydraulic seal between the body portions being maintained by an O-ring 35 backed up by suitable back up rings 36 and 37. The body portions 32*a*, 32*b* are held together by cap screws 38. A top cable end fitting 40 is secured to the upper end of the cable 25 and includes an externally threaded portion 40*a* provided with opposed flat portions 40*b* to provide for an attachment of the cable 25. The jack body 32 is provided with a central internally threaded opening 42 threaded onto the threaded portion 40*a* of the top cable end fitting 40. Additionally, the jack body 32 is provided with an annular groove 44 concentrically positioned with the central opening 42 and defining an annular jack cylinder closed at its upper end and open at its lower end.

An annular jack piston assembly 46 is slidably received within the jack cylinder 44 and includes a ram portion 46*a* projectable through the lower open end of the cylinder 44. Thus, the piston assembly 46 is formed as a cylindrical open center or annular piston and includes two annular seals 47, 48 retaining the hydraulic integrity in the cylinder. These two seals 47, 48 are held in place on the piston by a retainer 49 attached to the piston in any suitable manner as by screws 50. The outer and inner side wall surfaces of the piston assembly 46 are provided with bronze slip rings 52, 53 to reduce friction and to act somewhat as piston rings in their locality. The ram 46*a* of the jack 30 bears against a suitable wear plate 72. Ingress of dirt or other foreign matter to the lower open segment of the cylinder 44 is prevented by a pair of wiper rings 54, 55 closing the lower open end of the cylinder 44 between the cylinder wall thereof and the ram 46*a*. A cap 60 fits over the upper end of the jack body 32, secured thereto by cap screws 61. The cap 60 serves to prevent backing up of the cap screws 38 holding the two jack body portions 32*a*, 32*b* together and further serves as protection of the thread projecting through the jack body 32. Additionally, a grease fitting 62 may be provided in the cap 60 for the introduction of grease serving to prevent rust from forming on the upper end of the threaded portion 40*a* of the end fitting 40.

To provide for the introduction of hydraulic fluid under pressure into the upper closed end of the cylinder 44 there is provided a series of passageways communicating with the upper closed end of the cylinder 44 above the piston and adapted to receive pressurized fluid. Specifically, such passageways include a plurality of conventional grease fittings 65 communicating with the upper closed end of the cylinder 44 by passage means 66. As is well known, the grease fittings 65 contain therein conventional one-way check valves, generally of the type including a spring loaded ball biased against a valve seat, and additionally includes a fitting nipple 65*a* for receiving the discharge end of a conventional grease gun. The one-way check valves within the grease fittings 65 permit ingress only of hydraulic fluid. A suitable bleed valve 70 is provided which, when opened, will release the fluid within the upper closed end of the cylinder 44.

The illustrated embodiment of the jack is preferably adapted to work with high pressure grease, generally available at construction sites and provided by a suitable grease gun (not shown) which will attach to the nipple 65*a* of the grease fittings 65. Such high pressure grease can be supplied at pressures in the range of 2500 p.si. and will serve to provide the working medium of the jack. One common form of grease suitable for use in the present jack is that generally available for lubricating bearings in inaccessible places and bearings wherein housings are not sufficiently tight to hold oil; and grease supplied as a semi-solid lubricant made by incorporating suitable soap such as lithium or barium soap into a mineral base will be quite satisfactory.

The operation of the improved cable tensioning jack 30 is believed clear from the above detailed description. However, briefly, when hydraulic pressure is applied through the grease fitting 65 into the upper closed end of the cylinder 44, the piston ram 46*a* bearing against the wear plate 72 remains insitu and the jack body 32 moves upwardly applying tension to the end fitting 40 and correspondingly to the cable 25.

Advantageously, in the assembly of the cap 60 to the body 32 of the jack 30, flat portions 60*a* on the cap 60 will line up with the flat portions 40*b* on the threaded portion 40*a* of the end fitting 40. The wear plate is provided with corresponding flats 72*a* which also line up and engage the flat portions on the cable end fitting 40 preventing the cable fitting 40 from radial rotation. Thus, after the application of the requisite pretensioning force to the cable 25, the cap is so located as to engage the flat portions 40*b* and the cap screws 61 are installed. The flat engagement against the cable fitting 40 of the wear plate 72 and of the flat engaging portion 60*a* of the cap 60 will prevent rotation of the jack body 32 thus preventing backing off therefrom during operation and consequent releasing of the cable tension. Of course, for interim cable tension adjustment it is not necessary to remove the cap 60, but only to apply additional hydraulic grease pressure through the grease fittings 65, and as the piston exerts the force to additionally tension the cable 25, the cap 60 and the jack body 32 act as one and the original anti-rotational relationship of the cap 60 to the wear plate 72 is maintained.

If it is desired to release the pressure on the jack 30, it is necessary only to open the bleed valve 70, releasing the high pressure grease within the closed cylinder portion 44.

To provide for further tensioning of a cable 25 after the maximum stroke of the jack 30 has been reached, it is of course necessary to hold the position of the cable end fitting 40 as attained, and to further increase the tension. This is readily accomplished by means of a manual jack 80, FIGS. 6 and 7. The manual jack 80 includes a jack plate 81 having a central, internally threaded opening and a plurality of smaller internally threaded openings 81*a*, 81*b* concentrically with the central opening 80*a* and radially outwardly of the jack body 32. Suitable jack screws 82 extend through the threaded openings 81*b* and bear against the wear plate. Thus, further tensioning of a cable 25 may readily be accomplished by first removing the jack cap 60 by removing the cap screws 61. The manual jack plate 81 is then threaded onto the threaded portion 42 of the cable end fitting 40 projecting above the jack 30 and the jack screws 82 are tightened down against the wear plate to hold the position of the end fitting 40. Now the bleed valve 70 may be opened to release the pressure on the jack piston assembly 46. The piston assembly 46 may be forced into a retracted position within the jack body 32 until it is in its furthermost withdrawn position. Then, with the jack plate 81 and jack screws 82 still intact, the entire cable tensioning jack 30 may be rotated downwardly toward the wear plate. This jack assembly is screwed down to the cable fitting until the jack piston 46 is again resting on the wear plate 72. At this point, the bleed valve 70 is closed and grease pressure is applied again to one or more of the grease fittings 65 with a high pressure grease gun and the process of jacking is repeated over again. When tension is applied the feet of the jack screws 82 will come clear of the wear plate and the jack plate and jack screws may readily be removed. At this time, the cap 60 may be replaced in its anti-rotational relationship with the flats of the cable fitting and cap screws reinstalled to complete the assembly.

It will be seen that there is provided a cable tensioning jack utilizing a source of grease under pressure commonly available at construction sites and providing for rapid and easy pretensioning or preloading of cable ties. Moreover, it has been found that a preload of 40 tons may readily be achieved by a cable tensioning jack wherein the annular piston assembly thereof has an inner effective diameter of 6½ inches and an outer effective diameter of 9 inches by the application of hydraulic grease under a pressure of 2500 p.s.i.

While the present invention has been illustrated and described in a single embodiment it will be understood that numerous changes and modifications will occur to those skilled in the art, and it is intended in the appended claims to cover all such changes and modifications as fall within the true spirit and scope of the present invention.

What is claimed as new and desired to be secured by Letters Patent of the United States is:

1. A percussion hammer for driving piles and the like comprising:

a housing having a cylinder portion and a lower portion;

a ram slidably mounted within said housing;

piston means slidably received within said housing and connected to reciprocate said ram;

a plurality of tie members interconnecting said cylinder portion and said lower portion, each of said tie members terminating in an externally threaded portion; and a cable tensioning jack mounted on a portion of said housing for tensioning each of said tie members relative to said cylinder portion, each of said cable tensioning jacks including:

a jack body having an internally threaded central opening threaded on the externally threaded portions of its respective tie member and having concentrically therewith an annular groove defining a jack cylinder closed at one end and open at the other;

an annular jack piston slidably received within said jack cylinder and including a portion projectable through the open end thereof bearing relative to said cylinder portion;

pressurizing means for connection to a high pressure fluid source in communication with the closed end of said cylinder above said piston to provide for admission of pressurized fluid into said cylinder and preventing escape of fluid therefrom; and a manual jack mounted on each of said tie members, each manual jack including a jack plate having a central opening, said externally threaded portions of each of said tie members being threaded into said central opening of one of said jack plates, said jack plates also having a plurality of jack screws in abutting engagement with said jack plate and said housing portion and concentrically positioned relative to said central opening of the respective jack plate radially outwardly of the respective cable tensioning jack.

2. A percussion hammer as set forth in claim 1 and including a pair of annular seals respectively sealing the inner diameter and outer diameter of said annular piston portion and cylinder.

3. A percussion hammer as set forth in claim 2 and further including a pair of annular wiper rings respectively positioned between the inner and outer diameters between said annular piston portion and cylinder.

4. A percussion hammer as set forth in claim 1 wherein said pressurizing means includes a one-way valve comprising a grease fitting.

5. A percussion hammer as set forth in claim 4 wherein said fluid is grease.

6. A percussion hammer as set forth in claim 1 and including a cap for covering said jack body when said manual jacks are removed.

7. A percussion hammer as set forth in claim 6 wherein said cable end fitting includes at least one flattened portion along its threaded length, and said cap includes flats engageably therewith thus locking the jack against rotation off the cable end fitting during use.

8. A percussion hammer of the type adapted for driving piles and the like including a housing having a cylinder portion and a lower portion interconnected by a plurality of tie members each terminating in an externally threaded portion, a cable tensioning jack assembly mounted on a portion of said housing for tensioning each of said tie members, each of said cable tensioning jack assemblies comprising:

a jack body having a central opening for receiving a cable portion and having concentrically therewith an annular groove defining a jack cylinder closed at one end and open at the other;

an annular jack piston slidably received within said jack cylinder and including a portion projectable through the open end thereof;

pressurizing means for connection to a high pressure fluid source in communication with the closed end of said cylinder above said piston to provide for admission of pressurized fluid into said cylinder; and a manual jack mounted on each of said tie members, each manual jack including a jack plate having a central opening for receiving one of said cable portions at a point above said jack body and having a plurality of jack screws in abutting engagement with said jack plate and said housing portion and concentrically positioned relative to said central opening of the respective jack plate radially outwardly of the respective cable tensioning jack.

9. A percussion hammer of the type adapted for driving piles and the like including a housing having a cylinder portion and a lower portion interconnected by a plurality of tie members each terminating in an externally threaded portion, a cable tensioning jack assembly mounted on a portion of said housing for tensioning each of said tie members, each of said cable tensioning jack assemblies comprising:

a jack body having a central opening for receiving a cable portion and having concentrically therewith an annular groove defining a jack cylinder closed at one end and open at the other;

an annular jack piston slidably received within said jack cylinder and including a portion projectable through the open end thereof;

pressurizing means for connection to a high pressure fluid source in communication with the closed end of said cylinder above said piston to provide for admission of pressurized fluid into said cylinder;

securing means associated with said central opening for securing each of said jack bodies to its respective cable-portion;

said cable portion including a cable end fitting threaded on the outside and said securing means including internal threads in said central opening for threadingly receiving said cable end fitting; and a manual jack mounted on each of said tie members, each manual jack including a jack plate having a threaded central opening adapted to screw onto the external threads of a respective said cable end fitting at a point above said jack body and having a plurality of jack screws in abutting engagement with said jack plate and said housing portion and concentrically positioned relative to said central opening of its respective jack body radially outwardly of the respective cable tensioning jack.

* * * * *